US008083530B2

(12) United States Patent
Kobayashi

(10) Patent No.: US 8,083,530 B2
(45) Date of Patent: Dec. 27, 2011

(54) CIRCUIT BOARD CONNECTOR

(75) Inventor: Kazumasa Kobayashi, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 65 days.

(21) Appl. No.: 12/674,321

(22) PCT Filed: Aug. 20, 2008

(86) PCT No.: PCT/JP2008/064777
§ 371 (c)(1),
(2), (4) Date: Feb. 19, 2010

(87) PCT Pub. No.: WO2009/025276
PCT Pub. Date: Feb. 26, 2009

(65) Prior Publication Data

US 2011/0151722 A1 Jun. 23, 2011

(30) Foreign Application Priority Data

Aug. 22, 2007 (JP) ..... 2007-215538

(51) Int. Cl.
*H01R 12/00* (2006.01)

(52) U.S. Cl. ..... 439/79; 439/607.04

(58) Field of Classification Search ..... 439/67, 439/79, 80, 607.4, 607.01, 607.04
See application file for complete search history.

(56) References Cited

U.S. PATENT DOCUMENTS

| | | | | |
|---|---|---|---|---|
| 4,802,860 | A * | 2/1989 | Kikuta | 439/79 |
| 5,273,460 | A | 12/1993 | Arai | |
| 5,453,016 | A * | 9/1995 | Clark et al. | 439/79 |
| 5,641,290 | A | 6/1997 | Yagi | |
| 6,183,302 | B1 | 2/2001 | Daikuhara et al. | |
| 6,361,367 | B1 | 3/2002 | Daikuhara et al. | |
| 6,371,812 | B1 | 4/2002 | Daikuhara et al. | |
| 6,827,605 | B2 * | 12/2004 | Wu | 439/567 |
| 7,806,704 | B2 * | 10/2010 | Miyoshi et al. | 439/108 |
| 7,837,505 | B2 * | 11/2010 | Minich et al. | 439/607.08 |
| 2009/0269980 | A1 * | 10/2009 | Gong et al. | 439/607.01 |
| 2010/0173529 | A1 * | 7/2010 | He et al. | 439/660 |

FOREIGN PATENT DOCUMENTS

JP U-03-089980 9/1991

(Continued)

OTHER PUBLICATIONS

International Search Report issued in International Application No. PCT/JP2008/064777; Mailed on Sep. 30, 2008.

*Primary Examiner* — Renee Luebke
*Assistant Examiner* — Larisa Tsukerman
(74) *Attorney, Agent, or Firm* — Oliff & Berridge, PLC

(57) ABSTRACT

A circuit board connector with no delay (skew) of signals and no crosstalk of signals. In a circuit board connector, a plurality of terminals having horizontal portions to be connected to ends of electric wires and vertical portions extending downward from one ends of the horizontal portions and arranged to be connected to a signal pattern of a printed circuit board are included, vertical portions of upper terminals are located on the back side of vertical portions of lower terminals, are bent in the width directions, and the path lengths of the upper terminals and of the lower terminals are equal. A tip portion of the lower terminal is received by a receiving groove of an inner housing housing a base portion of the vertical portion of the adjacent terminal.

4 Claims, 9 Drawing Sheets

FOREIGN PATENT DOCUMENTS

| | | |
|---|---|---|
| JP | U-06-009068 | 2/1994 |
| JP | U-06-079085 | 11/1994 |
| JP | A-07-037632 | 2/1995 |
| JP | U-07-036370 | 7/1995 |
| JP | A-2000-012130 | 1/2000 |
| JP | A-2000-068006 | 3/2000 |

* cited by examiner

10

CIRCUIT BOARD CONNECTOR

TECHNICAL FIELD

The present invention relates to a circuit board connector, and specifically relates to a circuit board connector to be attached to a printed circuit board on which printed wiring is provided in order to send and receive signals to and from the printed circuit board and supply electric power to the printed circuit board.

BACKGROUND ART

Conventionally, an electrical/electronic appliance to be installed on a car such as an automobile is provided with a number of printed circuit boards on which electronic components, ICs (integrated circuits), and other components are mounted. To the printed circuit boards, electric wires arranged to send and receive signals to and from other devices and other printed circuit boards and supply electric power to the printed circuit boards are connected. In order to make a transit connection between the electric wires and the printed circuit boards, circuit board connectors are used.

A circuit board connector is generally configured such that a terminal arranged to send and receive signals is housed in a housing. For example, as shown in FIG. 9, a conventional circuit board connector 70 is configured such that a terminal 72 arranged to send and receive signals is housed in a dielectric 74, the dielectric 74 is sheathed with a shielding shell 76, and the shielding shell 76 is housed in a housing 78. The terminal 72 has a horizontal portion 72*a* to be connected to an end of an electric wire and a vertical portion 72*b* that extends downward from one end of the horizontal portion 72*a* in a vertical direction, which makes the terminal 72 have a substantially L shape.

When a circuit board connector is provided with a plurality of terminals, the plurality of terminals are often arranged in a plurality of layers in a height direction because of space limitations and other reasons. In order to locate the lower terminal inside the upper terminal so as to be parallel to the upper terminal, the path length of the upper terminal is made different from the path length of the lower terminal. Thus, in a differential manner in which data is transmitted through a pair of signal lines, a phase difference occurs between the upper terminal and the lower terminal, which could cause a delay (skew) of signals.

There has been accordingly an attempt to prevent a delay (skew) of signals. For example, Japanese Utility Model Application Laid-open Publication No. Hei6-079085 discloses a circuit board connector 80 in which terminals 82 are arranged in a plurality of layers in a height direction, as shown in FIG. 10. In the circuit board connector 80, an uppermost terminal 82*a* in a housing 84 is connected to a conductive region on a circuit board 86 that is closest to the housing 84, and a lowermost terminal 82*b* in the housing 84 is connected to a conductive region on the circuit board 86 that is farthest from the housing 84. Thus, lengths of the terminals 82 are substantially equal.

DISCLOSURE OF THE INVENTION

Problem to be Solved by the Invention

However, the circuit board connector 80 of Japanese Utility Model Application Laid-open Publication No. Hei6-079085 is large in the depth direction because the lowermost terminal 82*b* in the housing 84 is made longer in the depth direction of the housing 84 in order to make the length of the lowermost terminal 82*b* in the housing 84 substantially equal to the length of the uppermost terminal 82*a* in the housing 84. In addition, the lowermost terminal 82*b* is connected to the conductive region on the circuit board 86 which is farther from the housing 84 than the conductive region on the circuit board 86 to which the uppermost terminal 82*a* is connected. Accordingly, the lowermost terminal 82*b* and the uppermost terminal 82*a* intersect with each other, and thus a delay (skew) of signals easily occurs.

An object of the present invention is to overcome the problems described above and to provide a circuit board connector which allows for preventing occurrence of a delay (skew) of signals without making the circuit board connector large in the depth direction and allows for preventing a crosstalk of signals.

Means for Solving Problem

To achieve the objects and in accordance with the purpose of the present invention, a circuit board connector includes a plurality of terminals having horizontal portions arranged to be connected to ends of electric wires, and vertical portions extending downward from one ends of the horizontal portions and arranged to be connected to a signal pattern of a printed circuit board, wherein the horizontal portions of the plurality of terminals are arranged in a plurality of layers in a height direction, and the vertical portions of the terminals having the horizontal portions in the upper layer are located on a back side in a depth direction with respect to the vertical portions of the terminals having the horizontal portions in the lower layer, and the vertical portions of the terminals in the lower layer are bent in the width direction so as to make a path length of the terminals in the upper layer and a path length of the terminals in the lower layer equal.

The plurality of terminals are preferably arranged substantially parallel to each other when viewed from the width direction.

It is preferable that the plurality of terminals are housed in a housing comprising a plurality of insert holes into which the horizontal portions of the plurality of terminals are inserted and a plurality of receiving grooves arranged to receive the vertical portions of the plurality of terminals, and tip portions of the bent vertical portions of the terminals are received by the receiving grooves receiving base portions of the vertical portions of the adjacent terminals to said terminals.

It is preferable that the plurality of terminals are housed in the housing comprising the plurality of insert holes into which the horizontal portions of the plurality of terminals are inserted, and the plurality of receiving grooves arranged to receive the vertical portions of the plurality of terminals, and the tip portions of the bent vertical portions of the terminals are received by the receiving grooves receiving the base portions of the vertical portions of the first adjacent terminals to said terminals.

Effect of the Invention

In the circuit board connector according to the present invention in which the vertical portions of the terminals in the upper layer are located on the backside in the depth direction with respect to the vertical portions of the terminals in the lower layer, the upper terminals and the lower terminals do not intersect. Accordingly, a crosstalk of signals can be prevented. In addition, because the path length of the upper terminals and the path length of the lower terminals are made equal by bending, occurrence of a delay (skew) of signals is prevented without making the circuit board connector large in the depth direction.

By arranging the plurality of terminals substantially parallel to each other when viewed from the width direction, the circuit board connector is made smaller in the depth direction.

By receiving the tip portions of the bent vertical portions by the receiving grooves receiving the base portions of the vertical portions of the adjacent terminals, the receiving grooves are shared, which makes the connector smaller also in the width direction.

BRIEF DESCRIPTION OF THE DRAWINGS

FIG. 2A is an oblique view and FIG. 2B is a back view.

FIG. 3A is an oblique view and FIG. 3B is a back view.

BEST MODE FOR CARRYING OUT THE INVENTION

A detailed description of preferred embodiments of the present invention will now be provided with reference to the accompanying drawings. In a circuit board connector according to a preferred embodiment of the present invention, the side of the circuit board connector to be connected to an end of an electric wire is referred to as the front side, and the opposite side is referred to as the back side (the back side in the depth direction). An upper direction of a printed circuit board onto which the circuit board connector is attached is referred to as a height direction, and a direction that is perpendicular to both of the height direction and the depth direction is referred to as a width direction of the circuit board connector.

Figure 1:
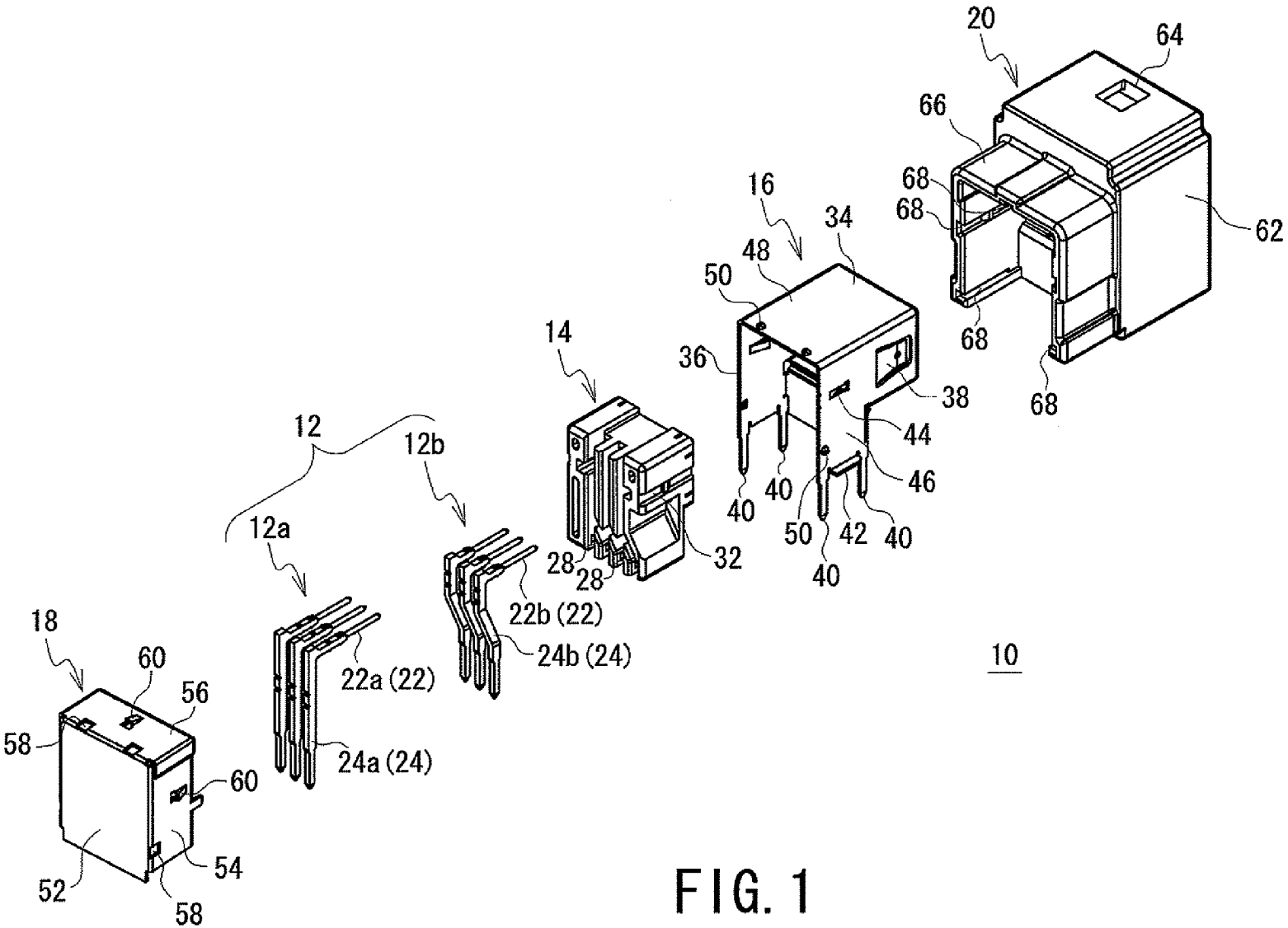
FIG. 1 is an exploded perspective view showing a circuit board connector according to a preferred embodiment of the present invention.

As shown in FIG. 1, a circuit board connector 10 according to a preferred embodiment of the present invention is configured such that a plurality of terminals 12 arranged to electrically connect ends of electric wires and printed wiring of a printed circuit board are housed in an inner housing 14, the inner housing 14 is sheathed with a shielding shell 16 arranged to electromagnetically shield the plurality of terminals 12 and a shell cover 18 arranged to cover the shielding shell 16, and the shielding shell 16 is housed in an outer housing 20.

The plurality of terminals 12 are preferably prepared by punching and bending a conductive plate material such as a metal plate material. The plurality of terminals 12 each include a horizontal portion 22 having a tab shape and arranged to be connected to a connecting terminal that is attached to the end of the electric wire, and a vertical portion 24 having a tab shape, extending downward from one end of the horizontal portion 22, and arranged to be connected to a signal pattern of the printed circuit board. Electrical connection of the vertical portion 24 to the signal pattern of the printed circuit board is performed by inserting the tip portion of the vertical portion 24 into a conductive through hole that is electrically connected to the signal pattern and then soldering the tip portion to the signal pattern.

Figure 2A:
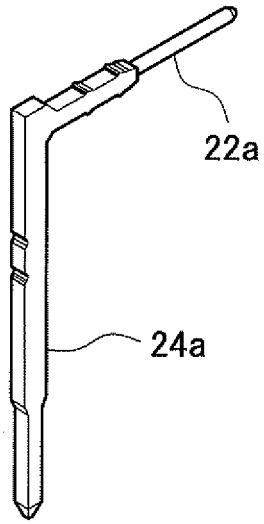
FIGS. 2A and 2B are views schematically showing an upper terminal.
Figure 2B:
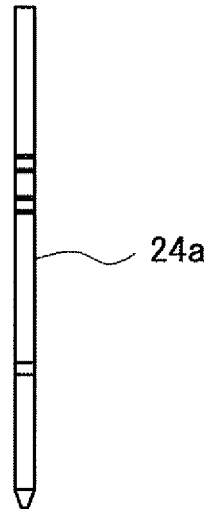
Figure 3A:
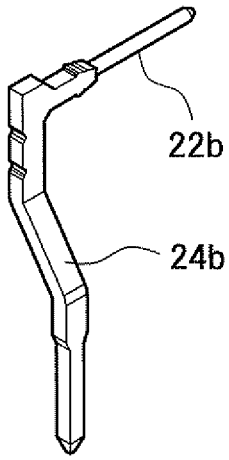
FIGS. 3A and 3B are views schematically showing a lower terminal.
Figure 3B:
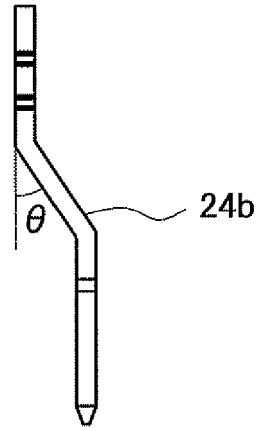

The plurality of terminals 12 are to be arranged in two layers in the height direction and in three rows in the width direction. As shown in FIGS. 2A and 2B, each of upper terminals 12*a* in the upper layer in the height direction has a horizontal portion 22*a* that extends substantially linearly and a vertical portion 24*a* that extends downward substantially linearly from the horizontal portion 22*a* at a substantially right angle with respect to the horizontal portion 22*a*, and accordingly, the upper terminal 12*a* have a substantially L shape as a whole. As shown in FIGS. 3A and 3B, a lower terminal 12*b* in the lower layer in the height direction has a horizontal portion 22*b* that extends substantially linearly and a vertical portion 24*b* that first extends downward substantially linearly from the horizontal portion 22*a* at a substantially right angle with respect to the horizontal portions 22*a*, is then bent to extend obliquely downward in the width direction, and is additionally bent to extend downward in the vertical direction. The lower terminal 12*b* is configured such that the horizontal portion 22*b* forms a substantially right angle with the vertical portion 24*b* and that the vertical portion 24*b* has a substantially S shape. By bending the vertical portion 24*b* of the lower terminal 12*b* in the width direction, the path length of the lower terminal 12*b* is made longer so as to be equal to the path length of the upper terminal 12*a*.

Figure 4:
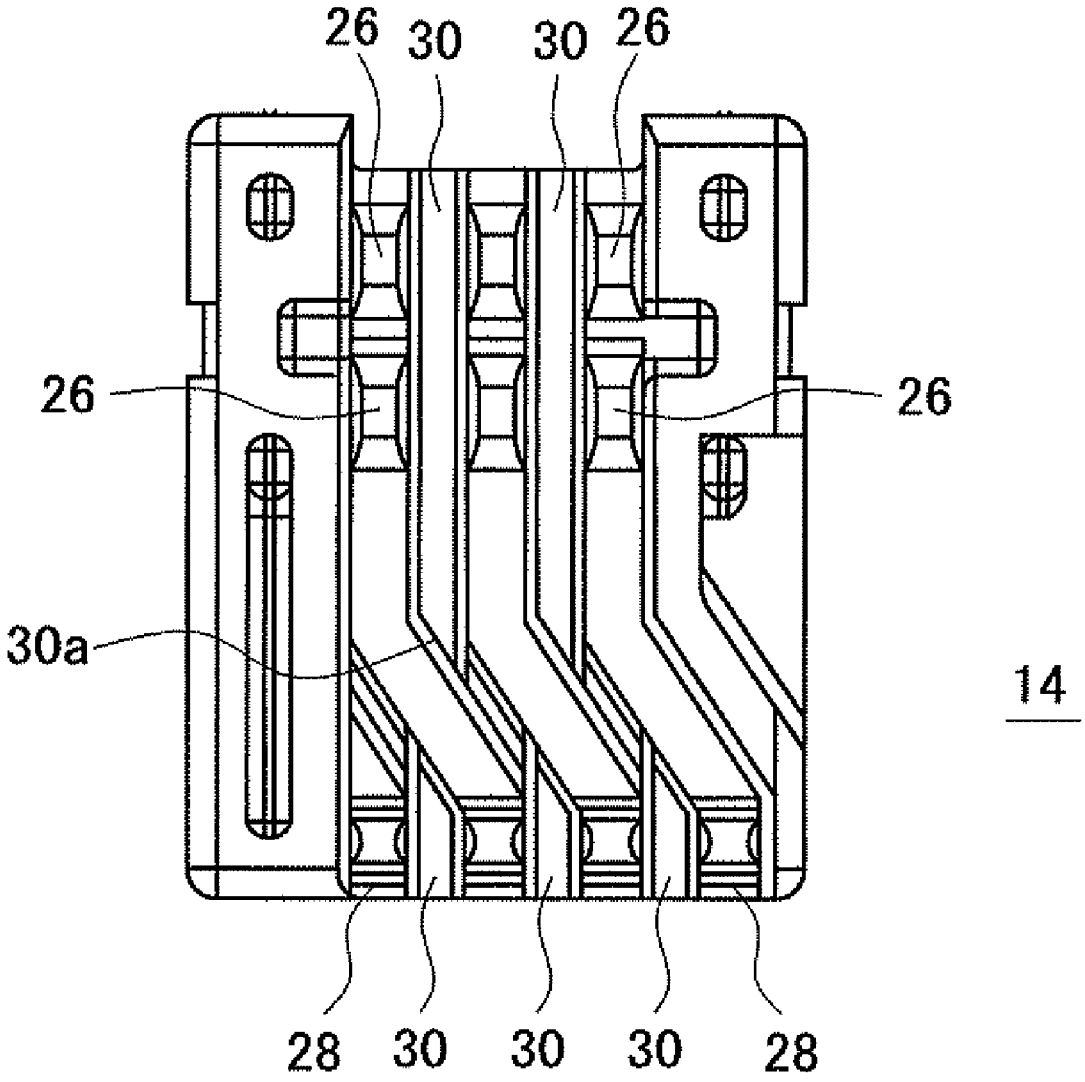
FIG. 4 is a view showing an inner housing when viewed from the back side.

The inner housing 14 arranged to house the plurality of terminals 12 is made from an insulating resin material having a given dielectric constant and is located between the plurality of terminals 12 and the shielding shell 16 in order to insulate them. As shown in FIG. 4, the inner housing 14 has a substantially box shape and includes a plurality of insert holes 26 into which the horizontal portions 22 of the plurality of terminals 12 are to be inserted. At one opening ends of the insert holes 26, a plurality of receiving grooves 28 extending in the vertical direction perpendicular to the opening direction of the insert holes 26 and arranged to receive the vertical portions 24 of the plurality of terminals 12 are provided. Division walls 30 arranged to divide the receiving grooves 28 are provided at midpoint positions with cut portions 30*a* that extend obliquely downward. Each of the cut portions 30*a* connects one receiving groove 28 and the adjacent receiving groove 28, which allows for receiving the oblique portion of the vertical portion 24*b* of the lower terminal 12*b*. The receiving groove 28 has such a depth that both of the upper terminal 12*a* and the lower terminal 12*b* are received by the receiving groove 28 while being stacked.

Figure 5A:
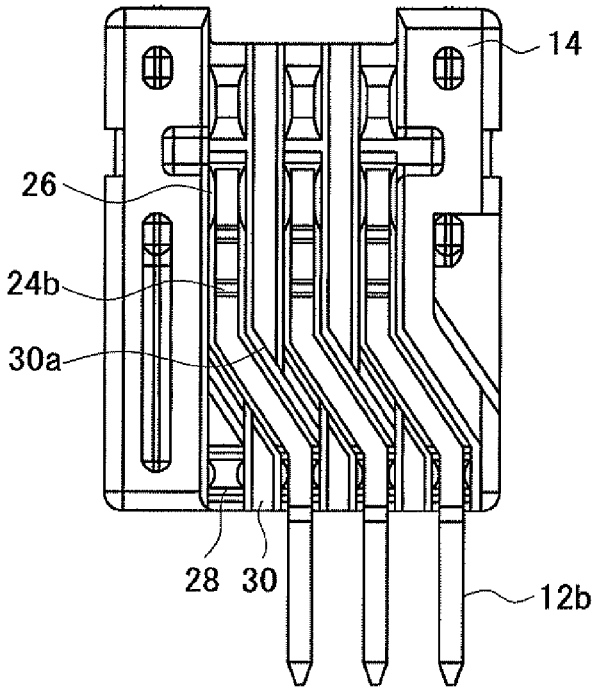
FIGS. 5A and 5B are views showing the process of housing a plurality of terminals in the inner housing.

The plurality of terminals 12 are housed in the inner housing 14. As shown in FIG. 5A, the lower terminals 12*b* of the plurality of terminals 12 are first housed in the inner housing 14. The horizontal portions 22*b* of the lower terminals 12*b* are inserted into the insert holes 26 that are disposed in the lower layer in the inner housing 14, and the vertical portions 24*b* of the lower terminals 12*b* are received by the receiving grooves 28. Because the vertical portions 24 of the lower terminals 12*b* are bent in the width direction, housing the oblique portions of the vertical portions 24 in the cut portions 30*a* of the division walls 30 dividing the receiving grooves 28 positions the tip portions of the vertical portions 24 at the adjacent receiving grooves 28, and accordingly, the tip portions of the vertical portions 24 are received by the adjacent receiving grooves 28. In other words, the tip portions of the vertical portions 24*b* of the lower terminals 12 are received by the adjacent receiving grooves 28 to the receiving grooves 28 receiving the base portions of the vertical portions 24*b*.

Then, the upper terminals 12*a* are housed in the inner housing 14. The horizontal portions 22*a* of the upper terminals 12*a* are inserted into the insert holes 26 that are disposed in the upper layer in the inner housing 14, and the vertical portions 24*a* of the upper terminals 12*a* are received by the receiving grooves 28. Because the vertical portions 24*a* of the upper terminals 12*a* extend substantially linear, one vertical portion 24*a* of one upper terminal 12*a* is received by one receiving groove 28. The vertical portions 24*a* of the upper terminals 12*a* are received by the receiving grooves 28 receiving the vertical portions 24*b* of the lower terminals 12*b* in the state of being stacked but not being in contact with the lower terminals 12*b*, and are located on the back side in the depth direction with respect to the vertical portions 24*b* of the lower terminals 12*b*.

The plurality of terminals 12 are arranged such that the horizontal portions 22 are arranged in a plurality of layers in the height direction and the vertical portions 24*a* of the upper terminals 12*a* are located on the back side in the depth direction with respect to the vertical portions 24*b* of the lower terminals 12*b*. The lower terminals 12*b* are located inside the upper terminals 12*a*, and the upper terminals 12*a* and the lower terminals 12*b* do not intersect with each other. Thus, the influence of signals transmitted through the upper terminals 12*a* (the lower terminals 12*b*) on signals transmitted through the lower terminals 12*b* (the upper terminals 12*a*) is made small, and a crosstalk of signals can be prevented in contrast to a connector in which upper terminals and lower terminals intersect with each other.

As described above, the path length of the lower terminals 12*b* and the path length of the upper terminals 12*a* are made equal by bending the vertical portions 24*b* of the lower terminals 12*b* in the width direction and making the vertical portions 24*b* be long. Thus, in the case of transmitting signals through a pair of signal lines by a differential manner, for example, a phase difference does not occur when signals are transmitted through the upper terminals 12*a* and the lower terminals 12*b*, and accordingly, a delay (a skew) of signals is prevented. In addition, an increase in the size of the connector in the depth direction is prevented, which brings about a great structural advantage.

The tip portions of the vertical portions 24*b* of the lower terminals 12*b* are received by the adjacent receiving grooves 28 to the receiving grooves 28 receiving the base portions of the vertical portions 24*b*, and share the adjacent receiving grooves 28 with the base portions of the vertical portions 24*b* of the adjacent lower terminals 12*b*, which also makes the circuit board connector smaller in the width direction. In addition, it is not necessary to prepare separate receiving grooves 28 for receiving the tip portions of the vertical portions 24*b*, which makes the structure of the inner housing 14 more simplified.

As described above, the path length of the lower terminals 12*b* is made longer by bending the vertical portions 24*b* in the width direction. The path length is preferably made longer by positioning the tip portion of the vertical portion 24*b* at a farther position, by enlarging the bend angle (the angle θ in FIG. 3B) of the vertical portion 24*b*, or by increasing the number of bendings of the vertical portion 24*b*. By adjusting the path length of the lower terminals 12*b* by the method described above, the path length of the lower terminals 12*b* is made equal to the path length of the upper terminals 12*a*.

Examples of positioning the tip portion at a farther position include receiving the tip portion of the vertical portion 24*b* of the lower terminal 12*b* by the second or third adjacent receiving groove 28 to the receiving groove 28 receiving the base portion of the vertical portion 24*b*. In other words, the present invention is not limited to receiving the tip portion by the first adjacent receiving groove 28.

Figure 5B:
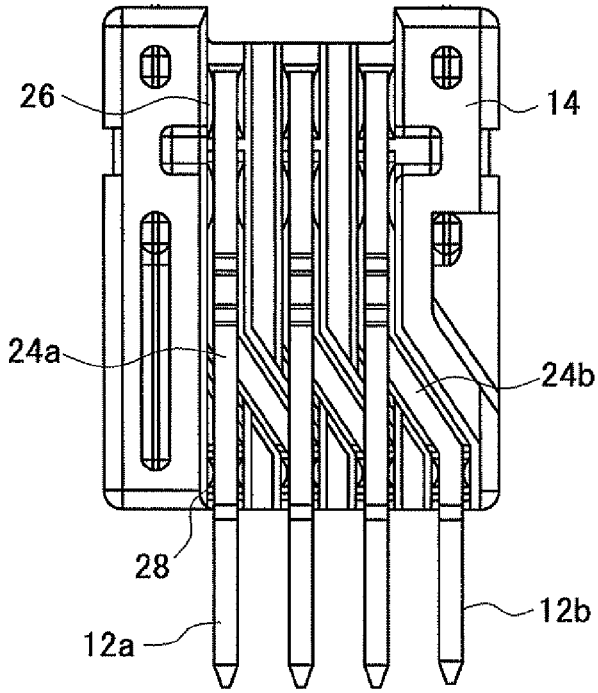
Figure 6:
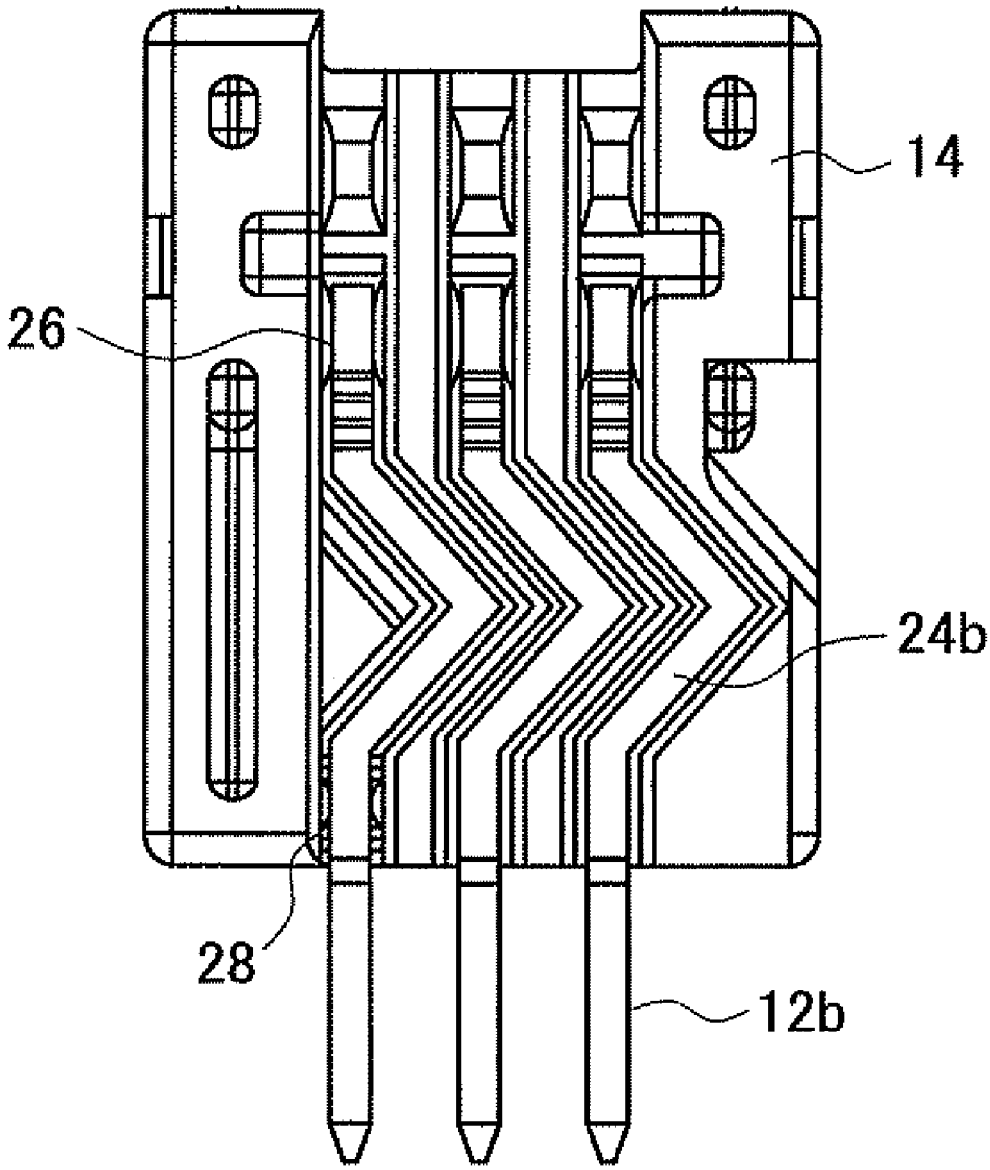
FIG. 6 is a view showing a plurality of terminals according to another preferred embodiment of the present invention being housed in an inner housing.

The number of bendings may be three as shown in FIG. 6, for example. To be specific, the vertical portion 24*b* of the lower terminal 12*b* first extends downward substantially linearly at a substantially right angle with respect to the horizontal portion 22*b*, is then bent to extend obliquely downward in the width direction, is then bent to extend obliquely downward oppositely in the width direction, and is then bent to extend downward in the vertical direction. The tip portion of the vertical portion 24*b* of the lower terminal 12*b* is received by the receiving groove 28 receiving the base portion of the vertical portion 24*b*. The number of bendings of the lower terminal 12*b* in FIG. 6 is higher than the number of bendings of the lower terminal 12*b* in FIG. 5, and the path length of the lower terminal 12*b* in FIG. 6 is longer than the path length of the lower terminal 12*b* in FIG. 5.

The arrangement of the plurality of terminals 12 is not limited to two layers in the height direction, and the plurality of terminals 12 may be arranged in three or more layers in the height direction. In addition, the arrangement of the plurality of terminals 12 is not limited to three rows in the width direction, and the plurality of terminals 12 may be arranged in one, two, or four or more rows.

For example, in the case of using a plurality of terminals having a substantially L shape as with the case of the upper terminals 12*a* and arranging the plurality of terminals in three layers of upper terminals, middle terminals, and lower terminals in the height direction, the upper terminals are located on the back side of the middle terminals in the depth direction, and the middle terminals are located on the back side of the lower terminals in the depth direction, and accordingly, the order of path lengths from the longest to the shortest is the upper terminals, the middle terminals, and the lower terminals. However, by bending the middle terminals and the lower terminals in the width direction, the path length of the middle terminals and the path length of the lower terminals can be made equal to the path length of the upper terminals without intersecting with each other, and the connector is prevented from becoming larger in the depth direction. In bending the middle terminals and the lower terminals, the lower terminals are required to be made much longer by using a different bending manner from the bending manner of the middle terminals because the path length of the lower terminals is shorter than the path length of the middle terminals.

For example, the vertical portion may be bent in the width direction such that the tip portion of the middle terminal is received by the first adjacent receiving groove, and the tip portion of the lower terminal is received by the second adjacent receiving groove. The bending angle of the lower terminal may be made greater than the bending angle of the middle terminal. The path length of the lower terminal may be made much longer by increasing the number of bendings of the lower terminal.

The inner housing 14 housing the plurality of terminals 12 is housed in the shielding shell 16. The inner housing 14 has on the side walls engaging concave portions 32 arranged to be engaged and held in the shielding shell 16.

The shielding shell 16 covering the inner housing 14 electromagnetically shields the plurality of terminals 12 housed in the inner housing 14. The shielding shell 16 is prepared by punching and bending a conductive plate material such as a metal plate material into a hollow body, and the inner housing 14 is housed in the hollow portion of the shielding shell 16. The shielding shell 16 has a substantially L shape in the same orientation as the upper terminals 12*a* when viewed from the width direction, and is provided with an engaging portion 34 having a rectangular tube shape extending in the horizontal direction and arranged to cover the horizontal portions 22 of the plurality of terminals 12, and a circuit board connecting portion 36 extending in the horizontal direction from the back side of the engaging portion 34 and arranged to connect the shielding shell 16 to the printed circuit board.

The engaging portion 34 has on the side walls tongue-shaped spring portions 38 that are bent slightly inward, and the spring portions 38 are brought into elastic contact with engaging portions of an outer conductor terminal (a shielding shell) of a counterpart connector.

The circuit board connecting portion 36 has on the side walls two pairs of tab-shaped leg portions 40 that are to be inserted into conductive through holes of the printed circuit board and extend downward in the vertical direction. By inserting and soldering the leg portions 40 into the through holes, the circuit board connecting portion 36 is electrically connected to the printed circuit board. A control projection portion 42 is disposed between each of the pairs of leg portions 40. The control projection portions 42 extend outward in the width direction from the side wall of the circuit board connecting portion 36 and are arranged to control the housing position of the shielding shell 16 by the outer housing 20.

The shielding shell 16 opens on the back side, which allows the shielding shell 16 to house the inner housing 14 from the back side. The shielding shell 16 has engaging projection portions 44 on the side walls that project inward at positions corresponding to the engaging concave portions 32 of the inner housing 14. When the inner housing 14 is housed in the shielding shell 16 from the back side, the engaging projection portions 44 of the shielding shell 16 are embedded in the engaging concave portions 32 of the inner housing 14 so as to engage and hold the inner housing 14 in the shielding shell 16.

On the back side of side walls 46 and a top wall 48, the shielding shell 36 has a plurality of engaging projection portions 50 that are arranged to engage and hold the shell cover 18 and project outward. The opening on the back side of the shielding shell 16 housing the inner housing 14 is covered with the shell cover 18.

The shell cover 18 is prepared by punching a conductive plate material such as a metal plate material. In order to provide overlaps with the side walls 46 and the top wall 48 of the shielding shell 16, the shell cover 18 has side walls 54 and a top wall 56 that extend from a main body wall 52 and are formed at right angles with the main body wall 52. On the side walls 54 and the top wall 56, the shell cover 18 has engaging holes 58 arranged to engage with the engaging projection portions 50 provided to the back side of the side walls 46 and the top wall 48 of the shielding shell 16. When the back side of the shielding shell 16 is covered with the shell cover 18, the engaging projection portions 50 of the shielding shell 16 engage with the engaging holes 58 of the shell cover 18, so that the shell cover 18 engages and holds the back side of the shielding shell 16. On the side walls 54 and the top wall 56, the shell cover 18 has control projection portions 60 that project outward and are arranged to control the housing position when the shielding shell 16 attached with the shell cover 18 is housed in the outer housing 20 from the back side.

The outer housing 20 arranged to house the shielding shell 16 is prepared from an insulating resin material and has a substantially box shape. The outer housing 20 has on the front side a hood portion 62 arranged to house a counterpart connector to be mated with the hood portion 62 and in the top wall an engaging hole 64 arranged to engage with an engaging projection portion of a connector housing of a counterpart connector. The outer housing 20 has on the back side a housing portion 66 arranged to house the shielding shell 16 and extending from the hood portion 62.

The housing portion 66 opens on the backside and on the lower side, which allows the housing portion 66 to house the shielding shell 16 from the back side. The housing portion 66 has on the inner walls guiding grooves 68 arranged to guide the control projection portions 42 and the control projection portions 60 that are arranged to control the housing position of the shielding shell 16 and extend from the back side to the front side. The shielding shell 16 is guided into the housing portion 66 of the outer housing 20 so as to be housed and held by the outer housing 20. The housing portion 66 opens on the front side and on the back side, and the front side communicates with the hood portion 62. When the shielding shell 16 is housed in the housing portion 66, the engaging portion 34 protrudes into the hood portion 62 and engages with a shielding shell of a counterpart connector.

Figure 7:
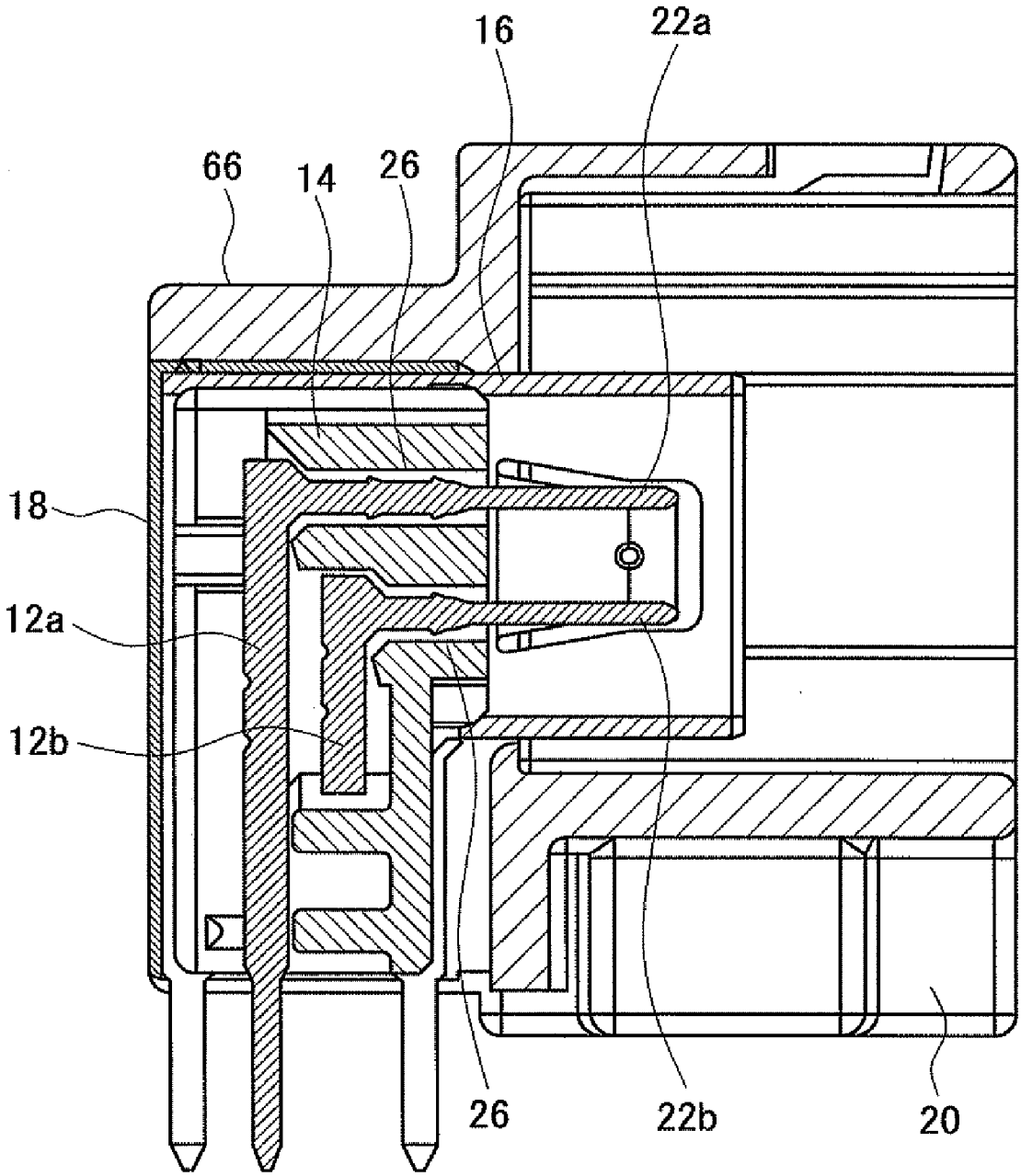
FIG. 7 is a lateral sectional view of the circuit board connector.

A description of assembly of the circuit board connector 10 having the configuration described above is provided below referring to a lateral cross-sectional view (see FIG. 7). First, the horizontal portions 22 of the plurality of terminals 12 are inserted into the insert holes 26 of the inner housing 14, and the plurality of terminals 12 are altogether housed in the inner housing 14. Then, the inner housing 14 housing the plurality of terminals 12 is inserted into the shielding shell 16, and the back side of the inner housing 14 is covered with the shell cover 18. The shielding shell 16 housing the inner housing 14 is inserted into the housing portion 66 of the outer housing 20 from the back side, and accordingly, assembly is completed. In the circuit board connector 10 after assembly, the upper terminals 12*a* are located on the back side in the depth direction with respect to the lower terminals 12*b* when viewed from the width direction. In addition, the upper terminals 12*a* and the lower terminals 12*b* are arranged substantially parallel to each other, which prevents the circuit board connector 10 from becoming larger in the depth direction.

Figure 8:
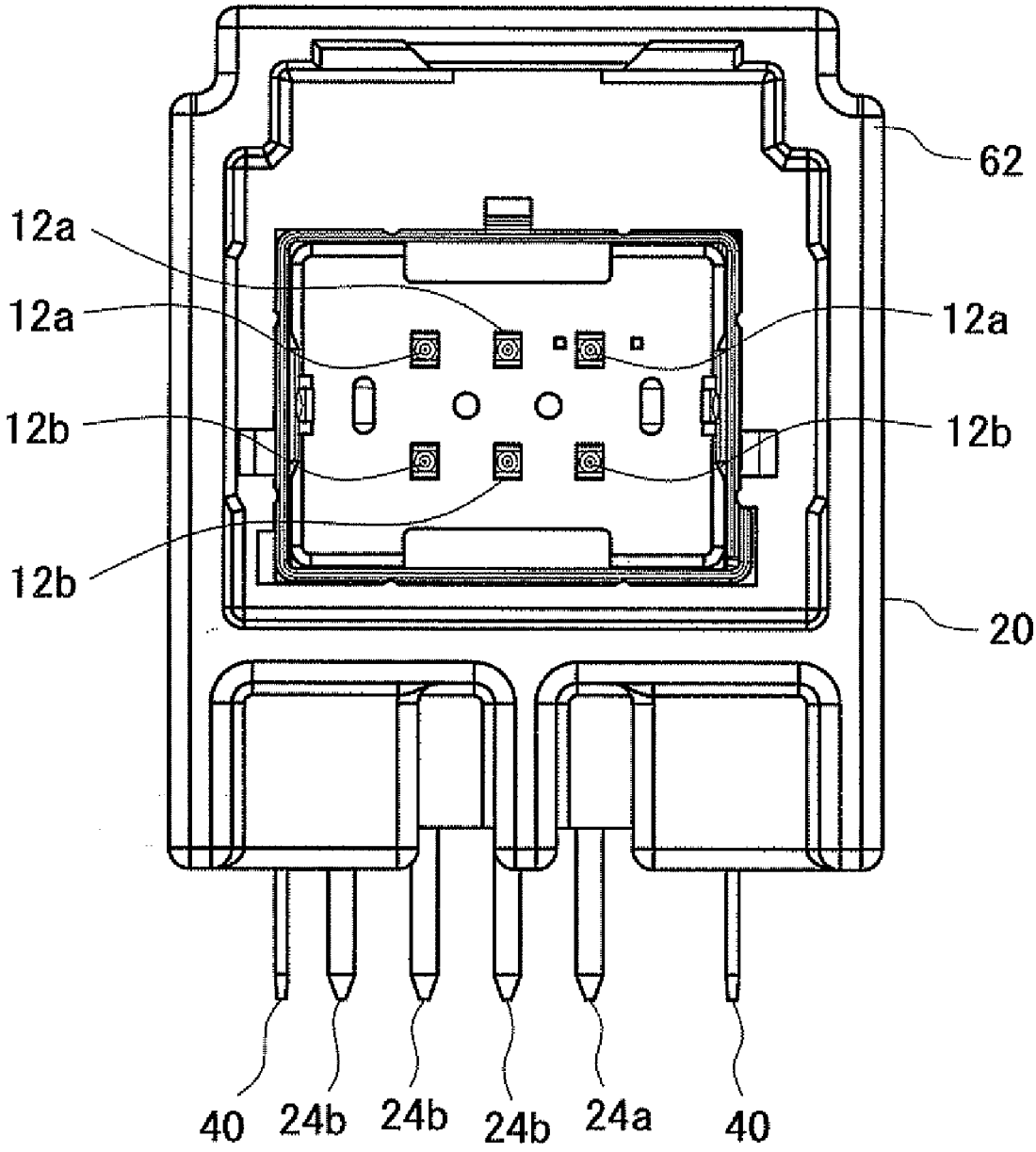
FIG. 8 is a front view of the circuit board connector when viewed from the front side.
Figure 9:
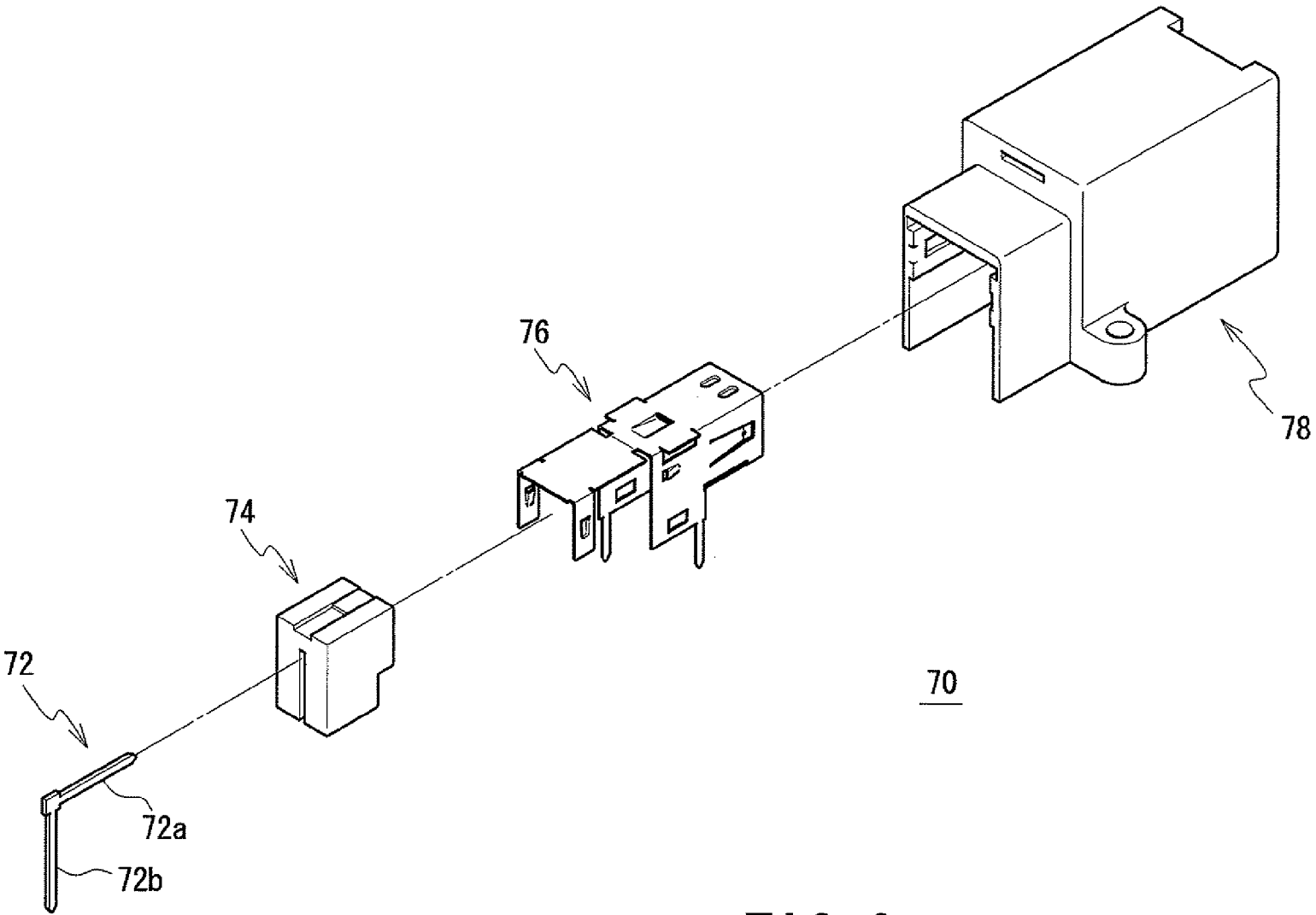
FIG. 9 is a view showing an example of a conventional circuit board connector.
Figure 10:
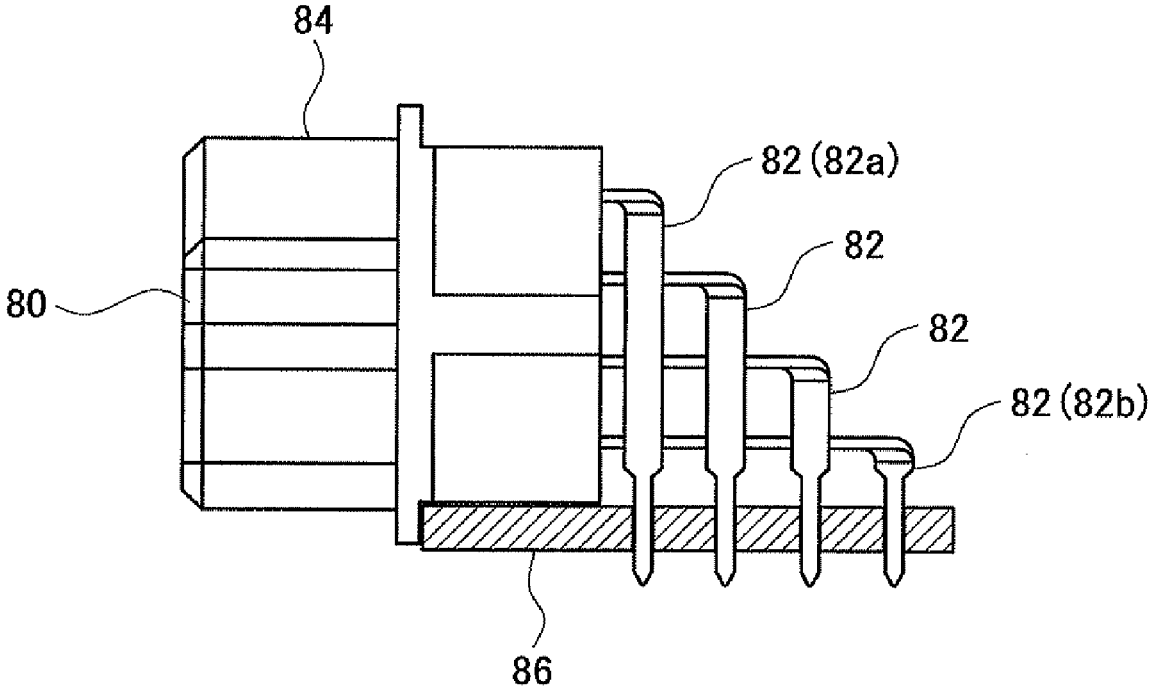
FIG. 10 is a view showing another example of a conventional circuit board connector.

In the circuit board connector 10 after assembly, as shown in FIG. 8, the ends of the horizontal portions of the plurality of terminals 12 are arranged in two layers and three rows in the hood portion 62, and the tip portions of the vertical portions 24 protrude outside at positions directly below the rows and at a position slightly apart from the rows. The leg portions 40 of the shielding shell 16 protrude outside at side positions in the width direction of the vertical portions 24. The vertical portions 24 of the plurality of terminals 12 and the leg portions 40 of the shielding shell 16 that protrude from the lower end of the outer housing 20 are inserted into and soldered to the through holes connected to the printed wiring of the printed circuit board, by which the circuit board connector 10 is electrically connected to the printed wiring of the printed circuit board.

The foregoing description of the shielded connector according to the preferred embodiments of the invention is not intended to be exhaustive or to limit the invention to the precise form disclosed, and modifications and variations are possible in the light of the above teachings or may be acquired from practice of the invention.

For example, although the circuit board connector 10 is provided with the shielding shell 16 according to the preferred embodiments of the present invention, the circuit board connector 10 may not be provided with the shielding shell 16. In addition, the plurality of terminals 12 arranged in the width direction may not be arranged substantially parallel to each other and may be bent in the opposite directions, for example. In addition, the upper terminals 12*a* and the lower terminals 12*b* may not be arranged substantially parallel to each other when viewed from the width direction, if they do not intersect with each other.

The invention claimed is:

1. A circuit board connector comprising:

a plurality of terminals having:

horizontal portions arranged to be connected to ends of electric wires; and vertical portions extending downward from the horizontal portions, the vertical portions being configured to be connected to a signal pattern of a printed circuit board, wherein the horizontal portions are arranged in a plurality of layers in a height direction, the plurality of layers in the height direction defining an upper layer and a lower layer, the vertical portions having the horizontal portions arranged in the upper layer being located on a back side in a depth direction with respect to the vertical portions having the horizontal portions arranged in the lower layer, and the vertical portions arranged in the lower layer are bent toward an out-of-plane direction of a plane including a horizontal portion and a vertical portion of one of the plurality of terminals having a horizontal portion arranged in the upper layer, so as to make a path length of the terminals arranged in the upper layer and a path length of the terminals arranged in the lower layer equal, and wherein the plurality of terminals are housed in a housing comprising a plurality of insert holes into which the horizontal portions of the plurality of terminals are inserted and a plurality of receiving grooves arranged to receive the vertical portions of the plurality of terminals, and a tip portion of a vertical portion of each of the plurality of terminals is received by one of the plurality of receiving grooves that is also receiving a base portion of a vertical portion of another one of the plurality of terminals.

2. The circuit board connector according to claim 1, wherein the plurality of terminals are arranged substantially parallel to each other when viewed from a width direction.

3. The circuit board connector according to claim 2, wherein a first terminal is adjacent to a second terminal, and a tip portion of a vertical portion of the first terminal is received by one of the plurality of receiving grooves that is also receiving a base portion of a vertical portion of the second terminal.

4. The circuit board connector according to claim 1, wherein a first terminal is adjacent to a second terminal, and a tip portion of a vertical portion of the first terminal is received by one of the plurality of receiving grooves that is also receiving a base portion of a vertical portion of the second terminal.

* * * * *